US005261393A

United States Patent [19]

Weinzweig

[11] Patent Number: 5,261,393

[45] Date of Patent: Nov. 16, 1993

[54] REMOVABLE FLEXIBLE FINGER COVERING WITH FINGERTIP CONNECTOR CLIP

[76] Inventor: Norman Weinzweig, 505 N. Lakeshore Dr., Apartment 5204, Chicago, Ill. 60611

[21] Appl. No.: 946,955

[22] Filed: Sep. 17, 1992

[51] Int. Cl.[5] ..... A61H 1/02

[52] U.S. Cl. ..... 128/26; 2/21

[58] Field of Search ..... 128/26, 25 R, 77; 602/64, 22, 60, 76, 62; 2/21, 163; 131/186, 257; 482/47, 48

[56] References Cited

U.S. PATENT DOCUMENTS

| | | | |
|---|---|---|---|
| 2,222,180 | 11/1940 | Marsh | 482/48 X |
| 2,646,796 | 7/1953 | Scholl | 602/60 |
| 2,740,121 | 4/1956 | Seidel | 2/21 |
| 2,827,635 | 3/1958 | Rasmus | 2/21 |
| 3,306,288 | 2/1967 | Rosenfield | 602/60 |
| 4,665,900 | 5/1987 | Saringer | 128/26 |
| 4,763,940 | 8/1988 | Held | 2/21 X |
| 4,765,608 | 8/1988 | Bonasera | 482/48 |
| 4,875,469 | 10/1989 | Brook et al. | 128/26 |

FOREIGN PATENT DOCUMENTS

| | | | |
|---|---|---|---|
| 848319 | 8/1970 | Canada | 482/48 |

OTHER PUBLICATIONS

"Efficacy of Continuous Passive Motion (CPM) Devices With Hand Burns", Covey, Dutcher, Marvin and Heimbach, Journal of Burn Care & Rehabilitation, vol. 9, (No. 4), pp. 396–400, 1988.

"Case Report on the Use of CPM on an Electrical Burn", McAllister and Salazar, Journal of Burn Care & Rehabilitation, vol. 9, (No. 5), p. 495, 1988.

"Application of CPM Devices with Burn Patients", Covey, Journal of Burn Care & Rehabilitation, vol. 9 (No. 5), pp. 496–497, 1988.

*Primary Examiner*—Richard J. Apley
*Assistant Examiner*—Beverly A. Meindl
*Attorney, Agent, or Firm*—Dressler, Goldsmith, Shore, Sutker & Milnamow, Ltd.

[57] ABSTRACT

A readily removable slip-on flexible finger covering having a tubular-shaped sleeve-like portion and an elongated elastic strap extending therefrom for securing thereon a fingertip connector for connection between an actuated drive bar of a continuous passive motion device and the fingertip connector located on the distal finger of a hand. The fingertip connector includes a base plate and a connector clip. The base plate is adapted to be secured to or retained by the finger covering and to provide contact with the distal digit of the finger. The connector clip extends outward therefrom and is adapted to engage with a complementary connector attachment that is attached to the drive bar or actuator.

9 Claims, 2 Drawing Sheets

FIG.1
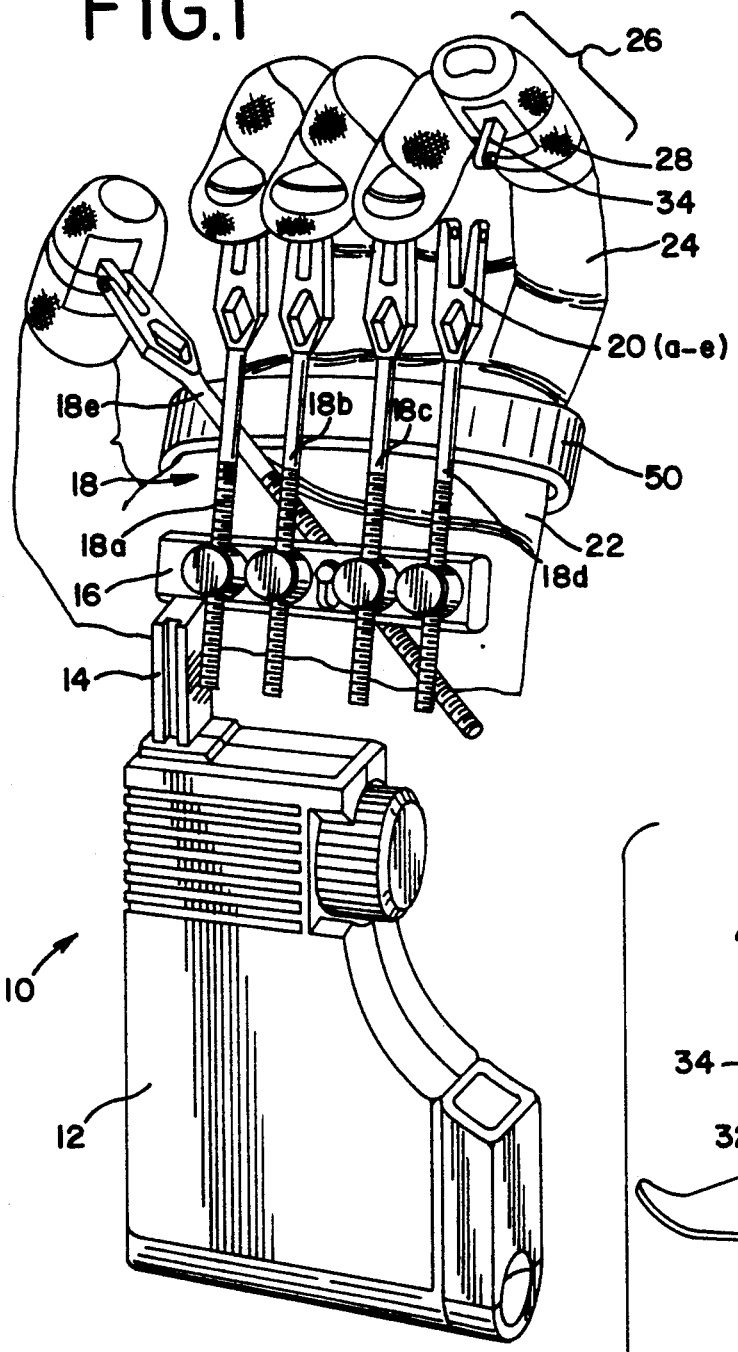
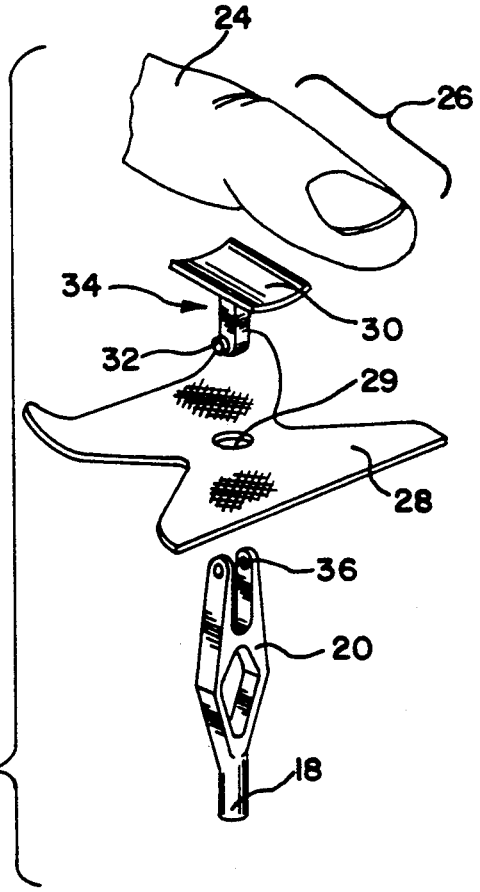
FIG.2

REMOVABLE FLEXIBLE FINGER COVERING WITH FINGERTIP CONNECTOR CLIP

BACKGROUND OF THE INVENTION

1. Field of the Invention

This invention generally relates to finger attachments for use with a continuous passive motion device for treating finger digit joints located on the hand, and relates more particularly to removable flexible finger coverings which allow a secure fingertip connection to be made with the continuous passive motion device.

2. Discussion

Continuous passive motion devices provide continuous passive motion to human body parts such as human joints, for example, a knee, elbow, wrist, or finger joints. Typically, the main purpose is to keep an injured or post operative joint mobile rather than immobile, thereby preventing any degeneration of the cartilage, soft tissue shortening, joint stiffness, or other such problems which result from lack of movement. Such devices have been used with hand injuries, such as severe burn injuries, where it is important that the burned hand not remain immobile for long periods of time, lest substantially irreversible (or difficult-to-reverse) atrophy occur.

A portable continuous passive motion device is disclosed in U.S. Pat. No. 4,665,900 issued to Saringer, which provides continuous mobilization of the hand digit joints. Such a device generally includes a harness or clamping mechanisms mountable on both the forearm and hand, with a motorized drive unit mounted on the inside portion of the forearm. Extending therefrom are drive bars which are connected to removable connectors mounted on the end digit of each finger of the hand. This results in the motor driven drive bars moving the fingers back and forth, i.e., reciprocal movement.

It is necessary to provide a secure connection between the outer most end of the drive bars and the end digit of each finger. This connection is typically provided by a removable snap-on connector consisting of a fingertip connector mounted on the end digit of each finger and connected to a complementary connector attachment located on the end of each drive bar. Traditionally, the fingertip connectors have been mounted to the end digit of each finger with the use of tape, knuckle bandages, adhesive strips, or secretarial rubber finger pads.

It is desirable to have a removable flexible elastic finger covering of a tubular shape that covers a substantial portion of and preferably the entire length of the finger, for securing the fingertip connector to the finger. Furthermore, it would be further desirable to have such a tubular-shaped finger covering with an elongated flexible strap protruding from the top side of the tubular portion, which may be fastened to a brace or clamp located on the back side of the hand or wrist, to help ensure the finger covering does not work itself off or slide down the covered finger during use. In addition, it is further desirable to have such a finger covering that is washable, breathable, and non-absorptive, which may be reusable.

SUMMARY OF THE INVENTION

According to the teachings of the present invention, a removable, elastic, stretchable, tubular-shaped, sleeve-like finger covering with an elongated stretchable strap extending therefrom provides a secure fingertip connection between an actuated drive bar or rod of a continuous passive motion device and the finger of a hand covered thereby. The finger covering is preferably made of elastic material of a tubular-shape approximately the length of a finger with a diameter slightly larger than the diameter of a finger such that the tube may be placed over a finger. The elastic material allows the finger covering to expand and contract in both length and diameter. This advantageously allows the finger covering to be placed over a bandaged or otherwise enlarged finger portion. The elastic material may be a woven elastic fabric, for example.

Extending from the upper portion of the tubular-shaped finger covering is an elongated stretchable strap with a sufficient length that allows the strap to be tied, clipped, snapped or otherwise fastened to a brace, clamp, or other device located on the back side of the hand or wrist. This elastic strap is preferably highly flexible so as not to provide significant resistance to bending of the finger, yet taut enough to ensure the finger covering remains in place on the finger during use.

The tubular-shaped finger covering and elongated strap is preferably washable, breathable, non-absorptive, reusable and sufficiently thin to allow the material to flex as the finger joints are mobilized. Suitable materials may include woven rayon, nylon, polyester and the like with a suitable percentage (10%) of elastomeric fibers such as spandex.

Located at the lower portion of the tip of the finger covering is an attachment device such as a small hole for attaching a fingertip connector to the finger covering. A fingertip connector made up of a connector clip and finger pad is inserted into the tubular portion of the finger covering with the connector clip protruding through the hole for connection to the drive bar. Other suitable attachment means may be used as discussed herein.

This invention advantageously provides a removable flexible finger covering which covers the length of the finger and may be worn over the top of bandages, other devices, or otherwise enlarged portions of the finger. More importantly, it includes a flexible, stretchable strap which provides sufficient tautness and ensures that the finger covering remains on the finger. In addition, the finger covering is made out of a breathable, non-absorptive, washable and therefore reusable material.

BRIEF DESCRIPTION OF THE DRAWINGS

The various advantages of the present invention will become apparent to those skilled in the art by reading the following specification and by reference to the drawings in which:

FIG. 1 is a perspective view of a prior art continuous passive motion device, illustrating the connection of the drive bars of same to fingertip connectors which are held in place by knuckle bandages;

FIG. 2 is an exploded perspective view of FIG. 1 of the end clip portion of the finger drive rod assembly in conjunction with the finger, finger clip, and bandage;

DESCRIPTION OF THE PREFERRED EMBODIMENT

Figure 3:
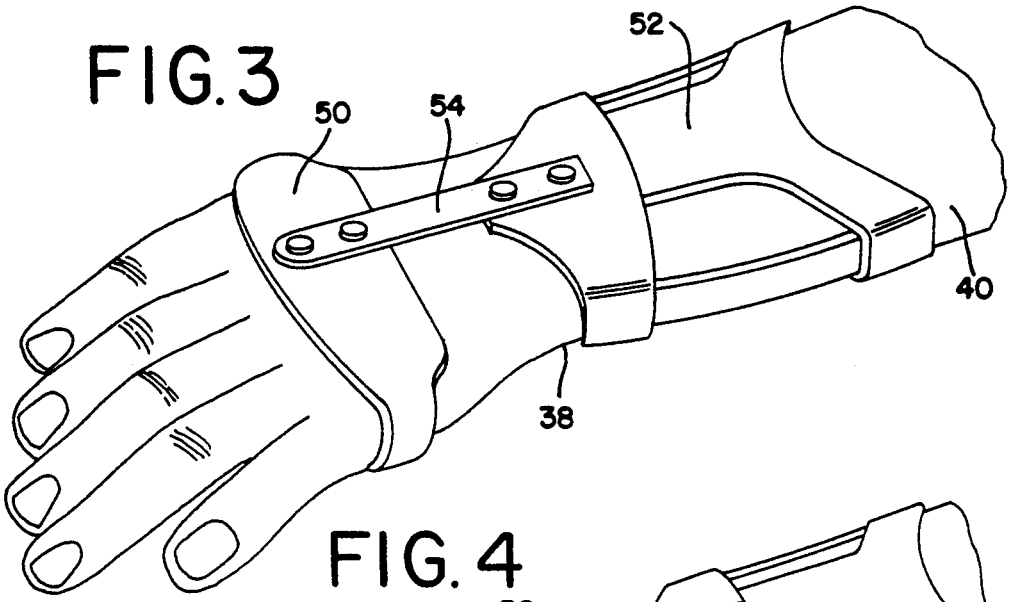
FIG. 3 is a perspective view of FIG. 1 illustrating the back portion of the hand and cross-brace clamps attached thereon.

Turning now to FIG. 1, a continuous passive motion device 10 is shown, for providing continuous mobilization of the finger joints on a hand. A drive housing 12 is mounted to the inside portion of a forearm 40, between the wrist 38 and elbow. The drive housing 12 is connected to an actuator bar 14 which in turn drives a spreader 38 with drive bars 18a through 18e mounted thereon. In all, there are five drive bars, one for each finger of the hand including the thumb. However, such a device may be equipped with fewer drive bars. Located at the outer end of each drive bar 18 is a snap-on connector device 20 for connecting the drive rod 18 to the fingertip connector 34. The fingertip connector 34 is attached and held to the inner or palm side portion of the end digit 26 of the finger 24 with the use of a knuckle bandage 28 provided with a hole 29 in the center.

FIG. 2 illustrates an exploded perspective view of the finger 24 in conjunction with the fingertip knuckle bandage 28, the drive bar connector 20, and the fingertip connector 34. The fingertip connector 34 includes a finger pad or base plate 30 approximately equal in length to the end digit 26 of the finger 24 which contacts the end digit 26 of the finger 24. Extending outwardly therefrom is a snap-on fingertip connector clip 32 which is removably connected to the end connector 20 of the drive bar 18. The base plate 30 of fingertip connector 34 is attached and held to the end digit 26 of the finger 24 by applying a knuckle bandage 28 wrapped around the fingertip. The fingertip connector clip 32 protrudes through a small hole 29 located on the knuckle bandage 28 and snaps into position within the holes 36 located on the drive bar connector 20.

In operation, the drive housing 12 provides continuous reciprocal movement of each of the drive bars 18a through 18e. This reciprocating motion forces the tip of each finger to move back and forth in conjunction with the drive bars 18 causing each finger to continuously curl and re-extend, resulting in mobilization of the finger digit joints.

FIG. 3 illustrates the back portion of the hand and wrist. Straps or braces 50 and 52 are strapped to both the forearm 40 of the patient's arm and the back portion of the palm of the hand. A cross-brace 54 is provided between the two clamping devices to prevent movement of the wrist or other body parts located therebetween, yet allow movement of body parts located outward therefrom.

Figure 4:
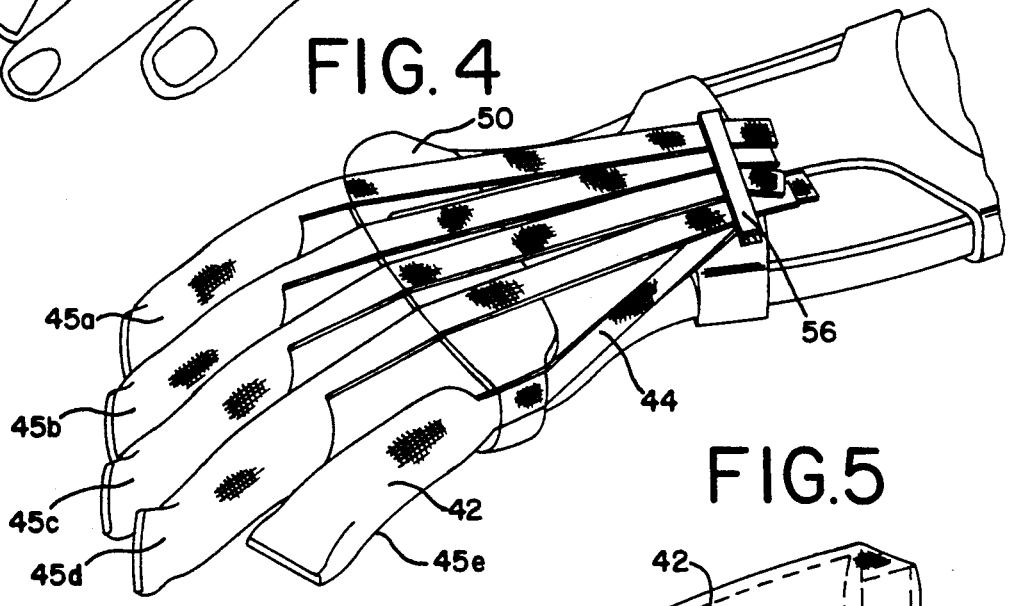
FIG. 4 is a perspective view of the back portion of the hand and fingers illustrating the finger coverings and attachment of the straps.

FIG. 4 illustrates the back side of the hand and wrist with the application of readily removable finger coverings 45a through 45e. An elongated stretchable strap 44 is provided to extend over the back portion of the hand and fastened to a cross-brace 56 or any supportable structure located on the back portion of the hand or wrist. The elongated strap 44 may be clamped to a brace as shown, however, any means of attachment may be used such as a conventional clip or snap.

Figure 5:
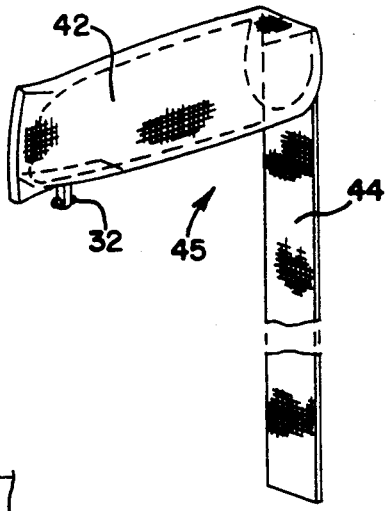
FIG. 5 is a perspective view of a readily removable finger covering.

FIG. 5 illustrates the flexible finger coverings 45. The finger covering 45 includes a tubular, sleeve-like portion 42 adapted to essentially fully cover the entire length of the finger. However, a covering of at least 60 percent of the end portion of each finger may suffice. Extending from the top side of the tubular portion of the finger covering 45 is an elongated elastic strap 44. This elongated strap 44 may be a part of the tubular portion 42 as shown or otherwise attached thereto. The length of the tubular portion 42 may be at least twice that of the diameter, while the elongated strap 44 may be at least twice the length of the tubular portion 42.

A hole is provided on the bottom side of the tip of the finger covering 45. The fingertip connector clip is inserted into the tubular sleeve-like portion 42 of the finger covering 45 and positioned so that the base plate remains inside the tubular portion 42 while the connector pins 32 protrude through the hole located in the finger covering 45. As such, the finger covering holds and maintains the fingertip connector 34 in position with the finger while a reciprocating drive bar 18 moves the finger back and forth. The stretchable elastic material comprising the finger covering 45 allows resulting forces that are applied to the fingertip connector 34 to be distributed throughout the material and absorbed through out the entire finger, finger covering, tubular portion 42 and elongated strap 44.

Figure 6A:
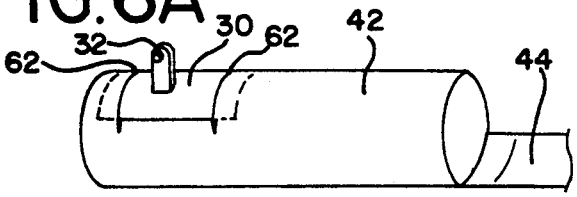
FIGS. 6a and 6b illustrate alternate methods for attaching the fingertip connector to the finger covering.
Figure 6B:
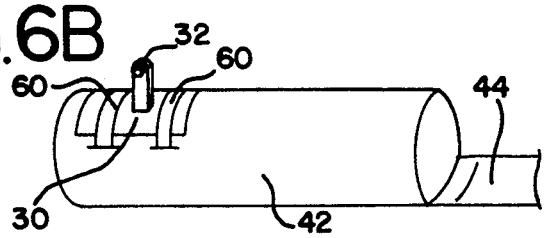

Alternate methods for attachment of the fingertip connector 34 to the finger covering 45 may be used as shown in FIGS. 6a and 6b. Such alternate means include the insertion of the end portion of the base plate 30 through two slits 62 in the finger covering 45 such that the mid portion of the base plate remains on the outer side of the finger covering. Another method includes a similar attachment with the use of flaps 60 provided on the outer portion of the finger covering.

The fingertip covering is preferably washable, breathable, non-absorptive, reusable, and sufficiently thin to allow the material itself to crease as the finger goes between a relatively straight position and a curled position. It may be made of various substrates including a woven and knitted substrate. Suitable fibers may include those prepared from rayon, nylon, Dacron and the like with a suitable percentage (10%) of elastomeric fibers such as natural and synthetic elastic rubber fibers, e.g., spandex. The fingertip connector is preferably made of a suitable substantially rigid material including stamped metal, or rigid molded plastic material such as ABS resin, nylon, polyvinyl chloride (PVC), polypropylene, or similar plastic polymers.

Both the tubular portion 42 and the elongated strap 44 are allowed to stretch in such a way as to provide enough tautness to ensure the finger covering 45 remains in place on the finger, while the reciprocating drive rods cause the finger to continuously bend, curl, and re-extend to a straight position. It is preferred that the strap be sufficiently long enough to allow attachment to be made above the back portion of the wrist or forearm, rather than immediate attachment near the base of the tubular portion. This allows for more elasticity resulting from a longer elongated strap.

In view of the foregoing, it can be appreciated that the present invention provides a finger covering for use with a continuous passive motion device. Thus, while this invention has been described in connection with a particular example thereof, no limitation is intended thereby except as defined by the following claims. This is because the skilled practitioner will realize that other modifications can be made without departing from the spirit of this invention after studying the specification and drawings.

I claim:

1. In a continuous passive motion apparatus for providing continuous motion to one or more fingers of a human hand, such apparatus comprising a cross brace for preventing movement of the hand and wrist, an actuator provided with one or more drive bars positioned on the palm or underside of the hand for communicating reciprocating movement to the distal ends of the fingers, one or more fingertip connector means for connecting said drive bars to the distal ends of the fingers and one or more finger covering devices for encasing the fingers adapted to attach to said fingertip connector means, wherein the improvement comprises:

at least one readily removable slip-on finger covering having a tubular sleeve-like portion adapted to essentially fully cover the entire length of the finger and being open at one end and closed at a second end and made of flexible elastic material;

an elongated strap portion extending outwardly from the open end of said tubular sleeve-like portion adapted to extend along the top portion of the hand and fasten to said cross brace;

a means for retaining said one or more fingertip connector means to said at least one finger coverings near the closed end of said tubular sleeve-like portion.

2. The covering as defined in claim 1, where the fingertip connector comprises:

a base plate adapted to contact the end digit of a finger; and a connector clip adapted for connection with a complementary fingertip connector.

3. The covering as defined in claim 2 whereby the connector clip is removably connected to an actuated drive member of a continuous passive motion device for mobilizing hand digit joints.

4. The covering as defined in claim 3 whereby the base plate of the finger covering is retained within the tubular sleeve-like portion while said connector clip protrudes through a small hole located in the finger covering for connection with said drive member.

5. The covering as in claim 3 wherein the flexible strap portion is part of the tubular sleeve portion and made of like material.

6. The covering as in claim 3 wherein the flexible strap portion is attached to the tubular sleeve portion.

7. The covering as in claim 1, wherein the tubular sleeve portion has a length equal to at least about twice its normal diameter, and the flexible strap portion has a length at least twice that of the tubular sleeve portion.

8. The covering as in claim 1, wherein the support member comprises a cross-brace located on the back side of a hand, wrist, or forearm to which the covered finger is interconnected.

9. The apparatus as defined in claim 7 wherein said retaining means comprises:

a hole located at the lower end portion of the tubular, sleeve-like portion of the finger covering through which a finger connector clip projects, while the base of the connector is retained therein.

* * * * *